US009425542B1

(12) United States Patent
Wu et al.

(10) Patent No.: US 9,425,542 B1
(45) Date of Patent: Aug. 23, 2016

(54) WATER-PROOF CONNECTOR

(71) Applicant: Cheng Uei Precision Industry Co., Ltd., New Taipei (TW)

(72) Inventors: Yun Wu, Dong-Guan (CN); Chao-Yong Ye, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/831,779

(22) Filed: Aug. 20, 2015

(51) Int. Cl.
*H01R 13/40* (2006.01)
*H01R 13/52* (2006.01)

(52) U.S. Cl.
CPC ..... *H01R 13/521* (2013.01); *H01R 13/52* (2013.01); *H01R 13/5213* (2013.01)

(58) Field of Classification Search
CPC ..... H01R 13/6275; H01R 12/724; H01R 13/6594
See application file for complete search history.

(56) References Cited

U.S. PATENT DOCUMENTS 6,319,063 B1 * 11/2001 Huang ..... H01R 13/65802 439/607.34
8,337,245 B1 * 12/2012 Wang ..... H01R 12/724 439/271
8,430,695 B2 * 4/2013 Ting ..... H01R 13/521 439/660
8,662,928 B1 * 3/2014 Xie ..... H01R 13/6594 439/607.35
9,153,906 B1 * 10/2015 Wu ..... H01R 13/6275

* cited by examiner

*Primary Examiner* — Xuong Chung Trans
(74) *Attorney, Agent, or Firm* — Cheng-Ju Chiang

(57) ABSTRACT

A water-proof connector includes a housing, a plurality of terminals and a waterproof component. The housing has a base portion, a center of a top face of the base portion defines a cavity, a bottom of the cavity defines a plurality of terminal grooves extending frontward and rearward and penetrating a rear face of the base portion. The plurality of terminals are assembled in the terminal grooves of the housing. The waterproof component includes an insulation cover board, a sealing element. The insulation cover board is assembled in the cavity, the sealing element is secondary molded in a rear end of the cavity of the housing and on a rear end of the insulation cover board.

14 Claims, 7 Drawing Sheets

WATER-PROOF CONNECTOR

BACKGROUND OF THE INVENTION

1. Field of the Invention

The present invention relates to a connector, and more particularly to a water-proof connector.

2. the Related Art

The current electronic products develop a variety of different specifications of the communication protocol of data transmission. In order to apply different specifications of the communication protocol of data transmission, different forms of electrical connectors is produced. Among them, a lightning connector with function of reversible access is greatly convenient for data signals, electric connection, therefore the lightning connector is widely used. Along with the widespread use of the lightning connector, a socket connector mating with the lightning connector has also been widely developed. A traditional socket connector includes a housing, a plurality of terminals assembled in the housing, a shielding shell covering the housing and a lock piece. The shielding shell connects the socket connector to the electronic products. The lock piece inserts into the housing to fixing the lightning connector.

However, as an external interface, when the socket connector is applied to the water environment, the reliability of the socket connector will be greatly reduced. Therefore, a waterproof socket connector with a good sealing effect is needed to improve performance in the water environment.

SUMMARY OF THE INVENTION

An object of the present invention is to provide a waterproof connector. The water-proof connector includes a housing, a plurality of terminals and a waterproof component. The housing has a base portion, a center of a top face of the base portion defines a cavity, a bottom of the cavity defines a plurality of terminal grooves extending frontward and rearward and penetrating a rear face of the base portion. The plurality of terminals are assembled in the terminal grooves of the housing. The waterproof component includes an insulation cover board, a sealing element. The insulation cover board is assembled in the cavity, the sealing element is secondary molded in a rear end of the cavity of the housing and on a rear end of the insulation cover board.

As described above, the insulation cover board is assembled in the cavity, the sealing element is secondary molded in a rear end of the cavity of the housing and on a rear end of the insulation cover board, therefore, the terminal grooves are sealed, and then a water-proof function is improved.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
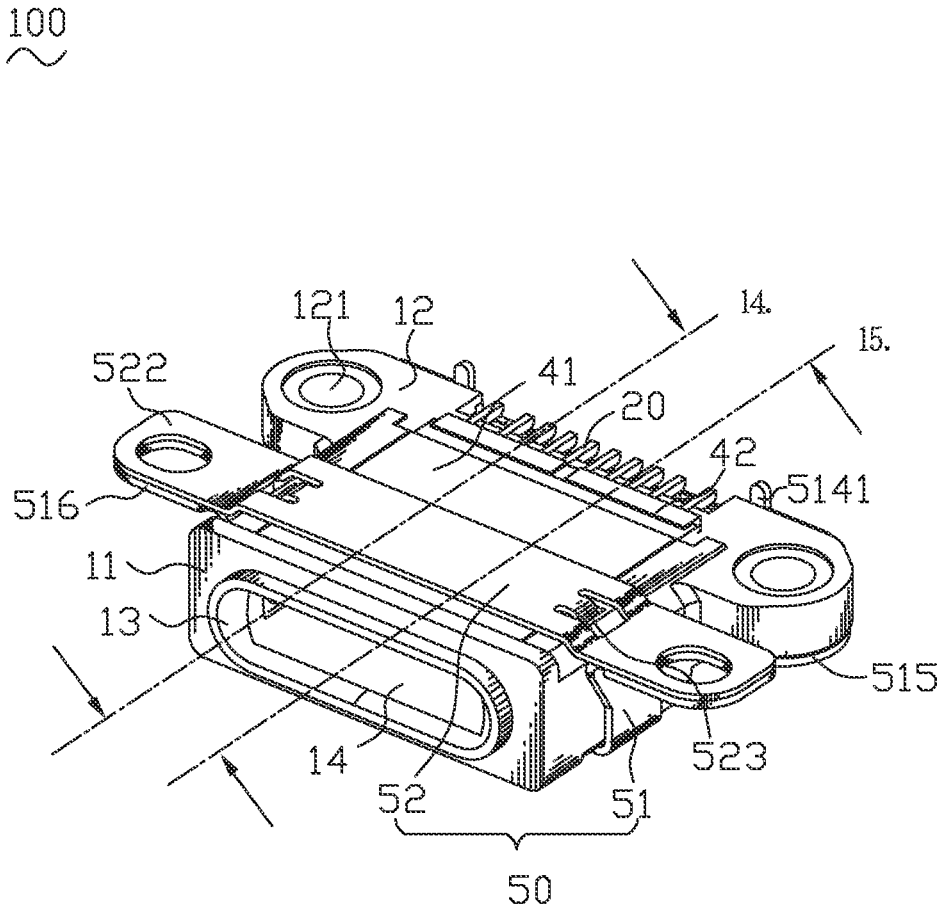
FIG. 1 is an assembled, perspective view of a water-proof connector in accordance with an embodiment of the present invention.
Figure 2:
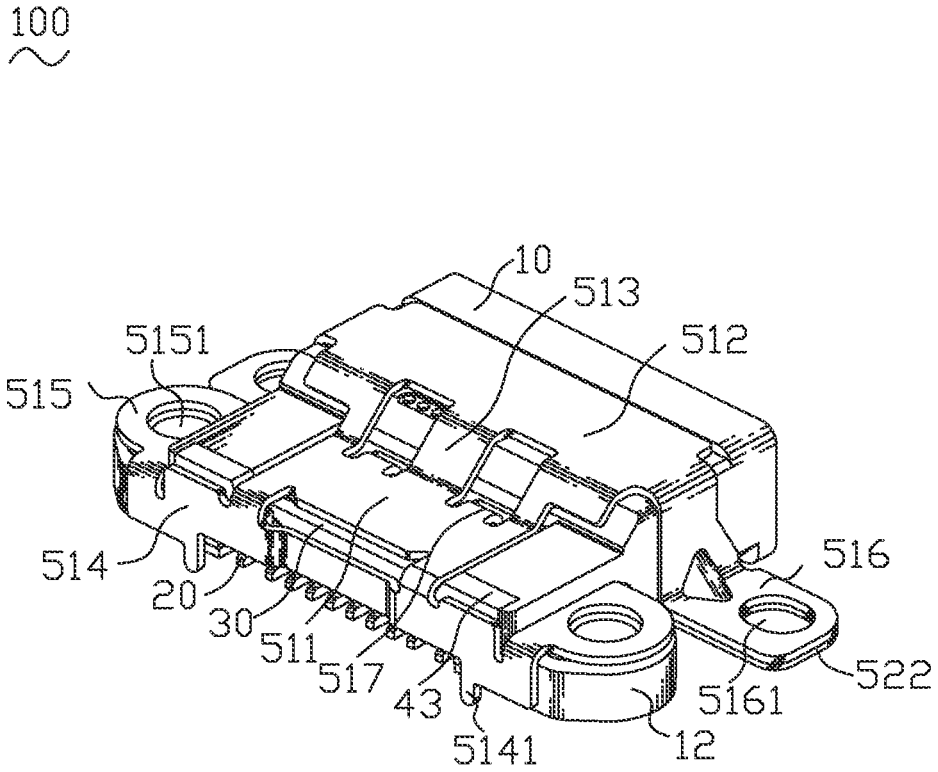
FIG. 2 is an assembled, another perspective view of the water-proof connector shown in FIG. 1.
Figure 3:
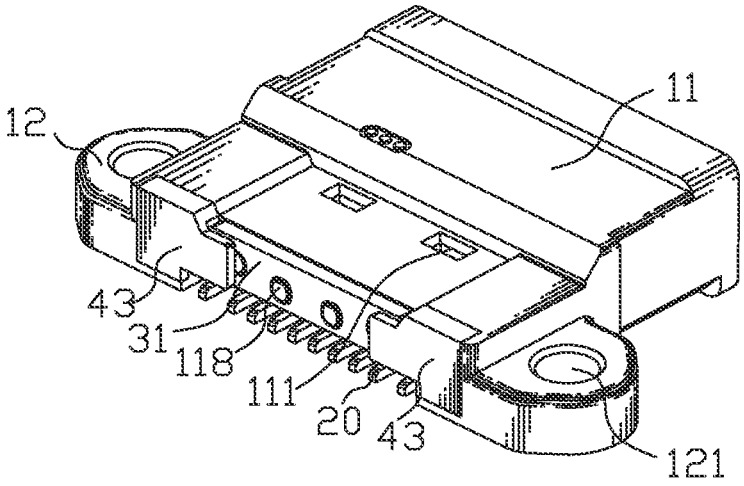
FIG. 3 is a perspective view of the water-proof connector shown in FIG. 2, without a shielding shell.

With reference to FIG. 1 and FIG. 2, an embodiment of the present invention is shown as a water-proof connector 100 includes a housing 10, a plurality of terminals 20, a lock piece 30, a waterproof component 40 and a shielding shell 50.

Figure 4:
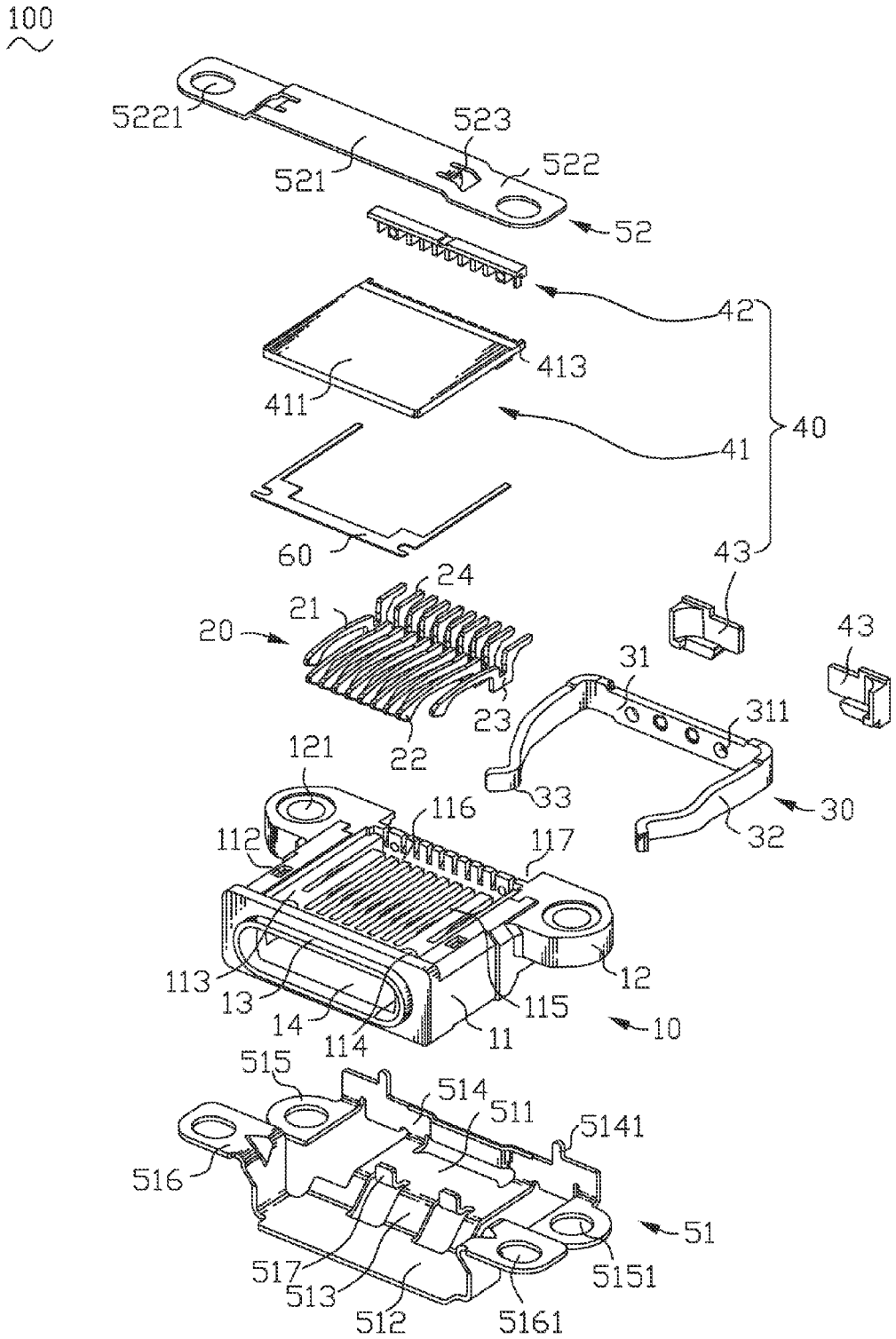
FIG. 4 is an exploded, perspective view of the water-proof connector shown in FIG. 1.
Figure 5:
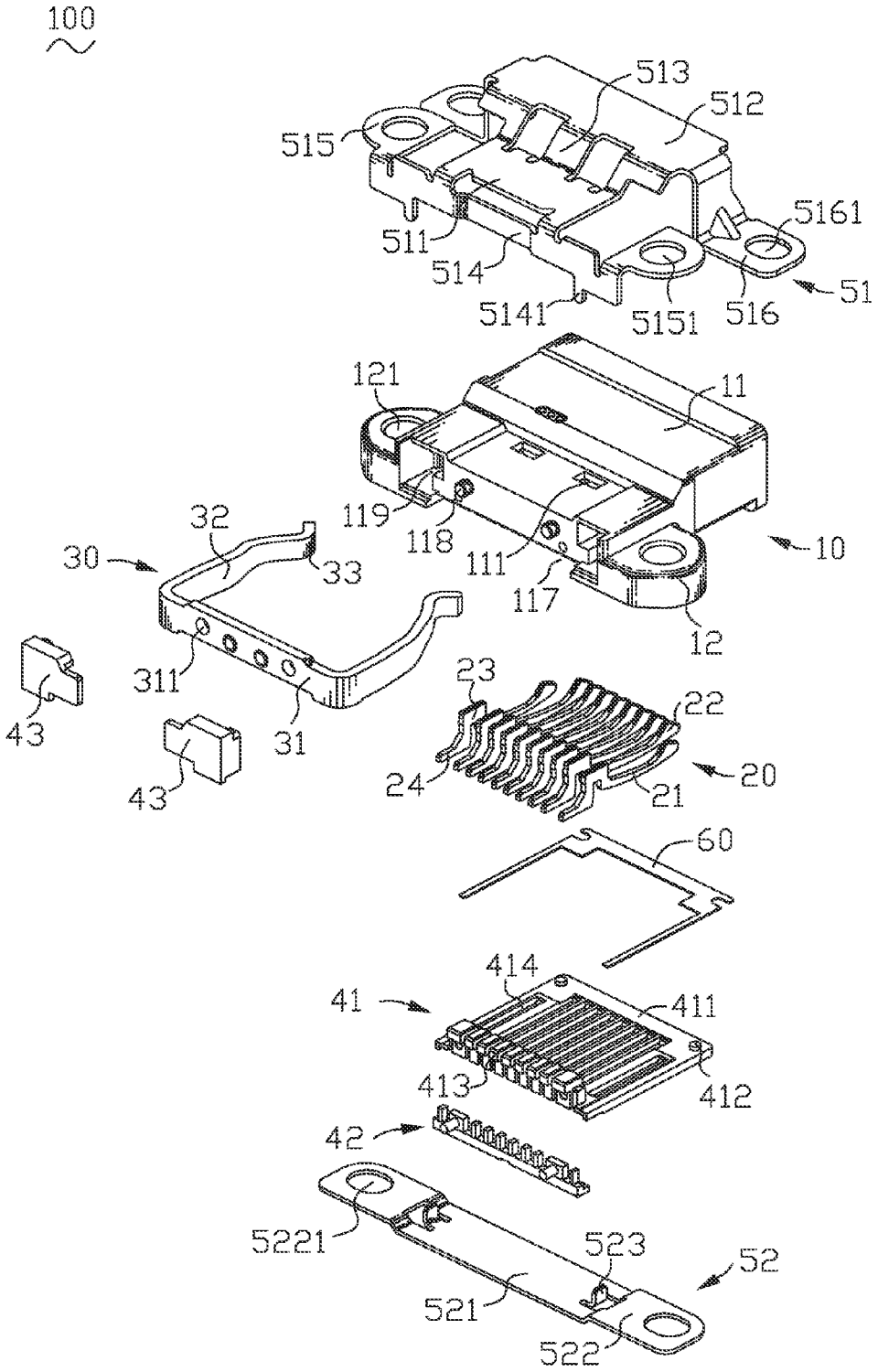
FIG. 5 is an exploded, perspective view of the water-proof connector shown in FIG. 2.
Figure 6:
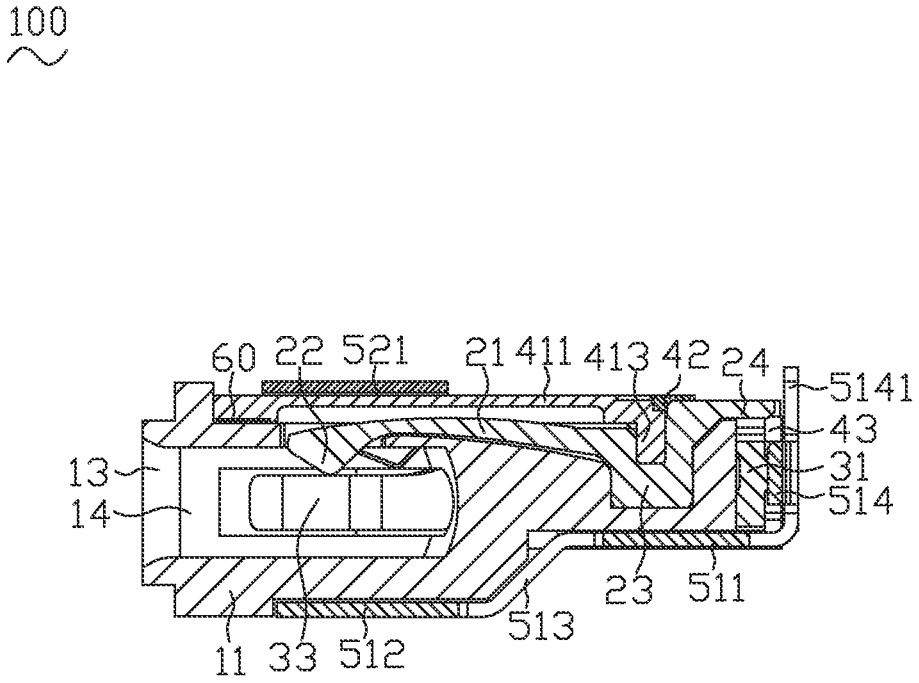
FIG. 6 is a cross-sectional view of the water-proof connector shown in FIG. 1.
Figure 7:
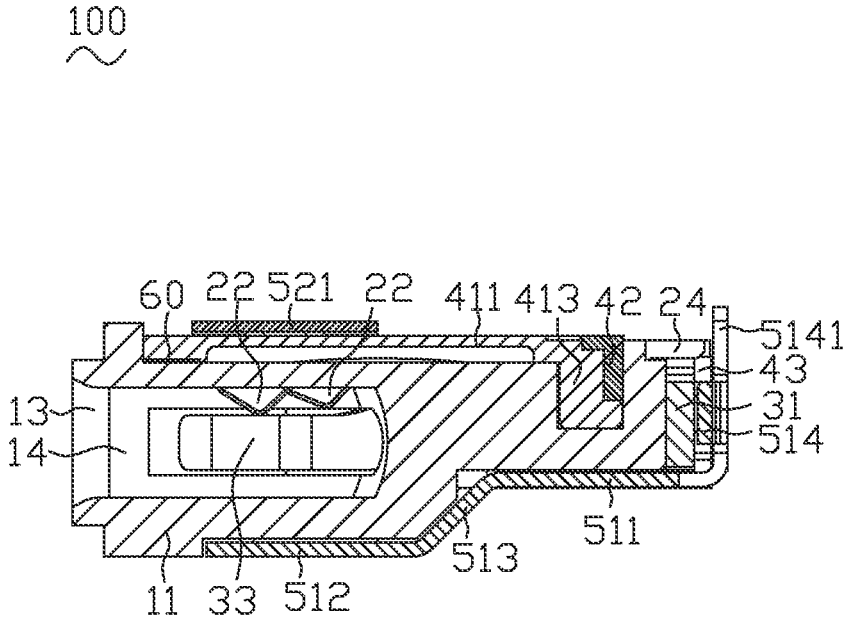
FIG. 7 is another cross-sectional view of the water-proof connector shown in FIG. 1.

Referring to FIG. 4 and FIG. 5, the housing 10 has a base portion 11. Two opposite sides of a rear end of the base portion 11 protrude outward to form a pair of wings 12. A front face of the base portion 11 protrudes frontward to form a plug part 13. A front face of the plug part 13 is recessed rearward to form a plug slot 14 extending to the base portion 11. Specifically, a bottom of the base portion 11 defines a plurality of lower locking slots 111. Two sides of a top of the base portion 11 define a plurality of upper locking slots 112. A center of the top of the base portion 11 defines a cavity 113. A bottom of the cavity 113 defines a plurality of locating slots 114 and a plurality of terminal grooves 115 extending longitudinally and penetrating a rear face of the base portion 11. A rear end of the bottom of the cavity 113 defines a transverse fastening slot 116 traversing rear ends of the terminal grooves 115. Front ends of the terminal grooves 115 communicate with the plug slot 14. Each of the wings 12 defines a first locking hole 121 penetrating through the wing 12 up and down. The rear face of the base portion 11 defines a recess 117. A front wall of the recess 117 protrudes rearward to form at least one positioning pillar 118. Two ends of the front wall of the recess 117 are concaved frontward to form two inserting slots 119. Front ends of the inserting slots 119 communicate with the plug slot 14.

Referring to FIG. 4 and FIG. 5, the plurality of terminals 20 are assembled in the terminal grooves 115 of the housing 10. The terminals 20 include two detect terminals (not labeled) and a plurality of signal terminals (not labeled). Each of the terminals 20 has a holding portion 21, a soldering portion 24 and a U-shaped fastening portion 23 connected between a lower edge of a rear end of the holding portion 21 and a lower edge of a front end of the soldering portion 24. A bottom edge of a front end of the holding portion 21 protrudes downward to form a first contact part 22.

Referring to FIG. 4 and FIG. 5, the lock piece 30 has a base plate 31 received in the recess 117. The base plate 31 defines at least one positioning hole 311 corresponding to the positioning pillar 118. Two ends of the base plate 31 are bent frontward and extended to form two clamping parts 32. A free end of the clamping part 32 is arched inward to form a second contact part 33.

Referring to FIG. 4 and FIG. 5, the waterproof component 40 includes an insulation cover board 41, a sealing element 42 and two elastic pieces 43.

The insulation cover board 41 is assembled in the cavity 113 to seal the terminal grooves 115. The insulation cover board 41 has a base board 411. A bottom face of the base board 411 has a plurality of positioning columns 412 corresponding to the locating slots 114 protruded downward. A rear end of the bottom face of the base board 411 protrudes downward and further protrudes rearward to form an L-shaped fixing lump 413. The bottom face of the base board 411 defines a plurality of slots 414 corresponding to the terminals 20. The slots 414 penetrate downward through the fixing lump 413.

The sealing element 42 is secondary molded in a rear end of the cavity 113 of the housing 10 and on a rear end of the insulation cover board 41. In this embodiment, the material of the sealing element 42 is plastic.

The two elastic pieces 43 are assembled in two sides of a rear end of the lock piece 30 and inserted in the inserting slots 119 to seal the inserting slots. In this embodiment, the elastic pieces 43 are rubber.

Referring to FIG. 1, FIG. 4 and FIG. 5, the shielding shell 50 covers the housing 10. The shielding shell 50 includes an upper shell 52 and a lower shell 51. The lower shell 51 has a rear base plate 511, a front base plate 512 and a connecting plate 513 connecting the front base plate 512 and the rear base plate 511. A rear edge of the rear base plate 511 connects with a stopping plate 514. Two sides of a top edge of the stopping plate 514 protrude upward to form two soldering feet 5141. The soldering feet 5141 are soldered on the circuit board (not shown). Two sides of a bottom edge of the stopping plate 514 are extended frontward and then transversely to form two rear locking plates 515 corresponding to the wings 12. The rear locking plate 515 defines a second locking hole 5151 corresponding to the first locking hole 121. Two sides of the front base plate 512 are bent and extended upward and further protrude outward to form two front locking plates 516. Each of the front locking plates 516 defines a third locking hole 5161. The lower shell 51 is punched upward to form a plurality of locking slices 517 corresponding to the lower locking slots 111.

The upper shell 52 has a upper base plate 521. Two sides of the upper base plate 521 are bent downward and then further extended outward to form two upper locking plates 522 corresponding to the front locking plates 516. Each of the upper locking plate 522 defines a fourth locking hole 5221 corresponding to the third locking hole 5161. The upper shell 52 is punched downward to form a plurality of locking slices 523 corresponding to the upper locking slots 112.

Referring to FIG. 1 to FIG. 7, in assembly, the terminals 20 are assembled in the terminal grooves 115 of the base portion 11 of the housing 10. The first contact parts 22 extend to the plug slot 14. The fastening portions 23 are fastened in a substantial junction of the terminal grooves 115 and the fastening slot 116. The soldering portion 24 is soldered on the circuit board.

In this embodiment, the insulation cover board 41 is glued in the cavity 113 with double-sided adhesive 60. The double-sided adhesive 60 is stuck on a front periphery and two side peripheries of the bottom face of the base board 411 of the insulation cover board 41. The positioning columns 412 are inserted in the locating slots 114. The fixing lump 413 is inserted in the fastening slot 116. After the insulation cover board 41 is assembled in the cavity 113, the sealing element 42 is secondary molded in a rear end of the cavity 113 of the housing 10 and on a rear end of the insulation cover board 41. The sealing element 42 is formed on the fixing lump 413 to seal the fastening slot 116 and further seal the terminal grooves 115.

The base plate 31 of the lock piece 30 is inserted in the recess 117. The positioning pillar 118 of the housing 10 is inserted in the positioning hole 311. The clamping part 32 is inserted into the inserting slot 119. The second contact part 33 of the lock piece 30 protrudes inward into the plug slot 14. The two elastic pieces 43 are inserted in the inserting slots 119 to seal the inserting slots 119.

The upper shell 52 is assembled in the top face of the housing 10. The lower shell 51 is assembled in the bottom face of the housing 10. The locking slices 517 of the lower shell 51 are locked in the lower locking slots 111. The first locking hole 121 and the second locking hole 5151 are connected by a fastening element (not shown). The stopping plate 514 spots welds on the base plate 31 by laser. The locking slices 523 of the upper shell are locked in the upper locking slots 112. The third locking hole 5221 and the fourth locking hole 5161 are connected by the fastening element.

As described above, the insulation cover board 41 is assembled in the cavity 115 of the housing 10, the sealing element 42 is secondary molded in a rear end of the cavity 113 of the housing 10 and on a rear end of the insulation cover board 41, the insulation cover board 41 and the sealing element 42 together seals the terminal grooves 115. The elastic pieces 43 seal the inserting slots 119. Therefore, a complete seal effect is achieved, and then a water-proof function is improved.

What is claimed is:

1. A water-proof connector, comprising:

a housing having a base portion, a center of a top face of the base portion defining a cavity, a bottom of the cavity defining a plurality of terminal grooves extending longitudinally and penetrating a rear face of the base portion;

a plurality of terminals assembled in the terminal grooves of the housing;

a waterproof component including an insulation cover board, a sealing element, the insulation cover board being assembled in the cavity, the sealing element being secondary molded in a rear end of the cavity of the housing and on a rear end of the insulation cover board; and a shielding shell covering the housing;

wherein the insulation cover board has a base board, a rear end of a bottom face of the base board protrudes downward and further protrudes rearward to form an L-shaped fixing lump, the bottom face of the base board defines a plurality of slots corresponding to the terminals, the slots penetrate downward through the fixing lump, a rear end of the bottom of the cavity of the housing defines a transverse fastening slot traversing rear ends of the terminal grooves, the fixing lump is located in the fastening slot, the sealing element is secondary molded in on the fixing lump.

2. The water-proof connector as claimed in claim 1, further comprising a locking piece and two elastic pieces, the lock piece having a base plate, two ends of the base plate being bent frontward and extended to form two clamping parts, the rear face of the base portion defining a recess, two ends of a front wall of the recess being concaved frontward to form two inserting slots, the base plate being received in the recess, the clamping parts are inserted into the inserting slots, the two elastic pieces being assembled in two sides of a rear end of the lock piece and inserted in the inserting slots to seal the inserting slots.

3. The water-proof connector as claimed in claim 2, wherein a front wall of the recess protrudes rearward to form at least one positioning pillar, the base plate defines at least one positioning hole corresponding to the positioning pillar, the positioning pillar is inserted in the positioning hole.

4. The water-proof connector as claimed in claim 1, wherein the elastic pieces are rubber.

5. The water-proof connector as claimed in claim 1, wherein each of the terminals has a holding portion, a soldering portion and a U-shaped fastening portion connected between a lower edge of a rear end of the holding portion and a lower edge of a front end of the soldering portion, a bottom edge of a front end of the holding portion protrudes downward to form a first contact part, the fastening portions are fastened in a substantial junction of the terminal grooves and the fastening slot.

6. The water-proof connector as claimed in claim 1, wherein the insulation cover board is glued in the cavity with double-sided adhesive.

7. The water-proof connector as claimed in claim 6, wherein the double-sided adhesive is stuck on a front periphery and two side peripheries of a bottom face of the base board of the insulation cover board.

8. The water-proof connector as claimed in claim 7, wherein a bottom of the cavity defines a plurality of locating slots, a bottom face of a base board of the insulation cover board has a plurality of positioning columns inserted in the corresponding locating slots.

9. The water-proof connector as claimed in claim 1, wherein a front face of the base portion protrudes frontward to form a plug part, a front face of the plug part is recessed rearward to form a plug slot extending to the base portion, front ends of the terminal grooves communicate with the plug slot, each of the terminals has a first contact part extending to the plug slot.

10. The water-proof connector as claimed in claim 1, wherein two opposite sides of a rear end of the base portion protrude outward to form a pair of wings, each of the wings defines a first locking hole penetrating through the wing up and down, the shielding shell includes an upper shell and a lower shell, the lower shell has a rear base plate, a rear edge of the rear base plate connects with a stopping plate, two sides of a bottom edge of the stopping plate are extended frontward and then transversely to form two rear locking plates corresponding to the wings, the rear locking plate defines a second locking hole corresponding to the first locking hole.

11. The water-proof connector as claimed in claim 10, wherein a bottom face of the base portion defines a plurality of lower locking slots, the lower shell is punched upward to form a plurality of locking slices corresponding to the lower locking slots, the locking slices of the lower shell are locked in the lower locking slots.

12. The water-proof connector as claimed in claim 10, wherein the lower shell further includes a front base plate and a connecting plate connecting the front base plate and the rear base plate, two sides of the front base plate are bent and extended upward and further protrude outward to form two front locking plates, each of the front locking plates defines a third locking hole, the upper shell has an upper base plate, two sides of the upper base plate are bent downward and then further extended outward to form two upper locking plates corresponding to the front locking plates, each of the upper locking plates defines a fourth locking hole corresponding to the third locking hole.

13. The water-proof connector as claimed in claim 12, wherein two sides of a top face of the base portion defining a plurality of upper locking slots, the upper shell is punched downward to form a plurality of locking slices corresponding to the upper locking slots, the locking slices of the upper shell are locked in the upper locking slots.

14. A water-proof connector, comprising:

a housing having a base portion, a center of a top face of the base portion defining a cavity, a bottom of the cavity defining a plurality of terminal grooves extending longitudinally and penetrating a rear face of the base portion;

a plurality of terminals assembled in the terminal grooves of the housing;

a waterproof component including an insulation cover board, a sealing element, the insulation cover board being assembled in the cavity, the sealing element being secondary molded in a rear end of the cavity of the housing and on a rear end of the insulation cover board; and a shielding shell covering the housing;

wherein two opposite sides of a rear end of the base portion protrude outward to form a pair of wings, each of the wings defines a first locking hole penetrating through the wing up and down, the shielding shell includes an upper shell and a lower shell, the lower shell has a rear base plate, a rear edge of the rear base plate connects with a stopping plate, two sides of a bottom edge of the stopping plate are extended frontward and then transversely to form two rear locking plates corresponding to the wings, the rear locking plate defines a second locking hole corresponding to the first locking hole.

* * * * *